United States Patent [19]

Frohbieter

[11] 4,360,977

[45] Nov. 30, 1982

[54] ROTATING HEAT EXCHANGER FOR A DRYER

[75] Inventor: Edwin H. Frohbieter, Lincoln Township, Berrien County, Mich.

[73] Assignee: Whirlpool Corporation, Benton Harbor, Mich.

[21] Appl. No.: 121,891

[22] Filed: Feb. 15, 1980

[51] Int. Cl.[3] ..... F26B 11/04

[52] U.S. Cl. ..... 34/86; 34/35; 34/133

[58] Field of Search ..... 34/35, 86, 75, 76, 133; 165/7, 10

[56] References Cited

U.S. PATENT DOCUMENTS

| | | | |
|---|---|---|---|
| 2,418,239 | 4/1947 | Smith | 34/77 |
| 2,862,434 | 12/1958 | Edwards . | |
| 2,865,611 | 12/1958 | Bentele . | |
| 2,888,248 | 5/1959 | Bubniak et al. . | |
| 2,958,140 | 11/1960 | Smith . | |
| 2,964,298 | 12/1960 | McIntosh et al. . | |
| 4,003,138 | 1/1977 | Wicks . | |
| 4,047,559 | 9/1977 | Asplund et al. | 165/7 |
| 4,063,587 | 12/1977 | Stockman | 165/10 |
| 4,270,282 | 6/1981 | Lotz | 34/86 |

FOREIGN PATENT DOCUMENTS

| | | | |
|---|---|---|---|
| 204817 | 12/1956 | Australia | 165/7 |
| 1410206 | 10/1968 | Fed. Rep. of Germany . | |

*Primary Examiner*—Larry I. Schwartz

*Attorney, Agent, or Firm*—Hill, Van Santen, Steadman, Chiara & Simpson

[57] ABSTRACT

A compact and lightweight rotary heat exchanger for transferring heat from a hot gas flow to a cold gas flow has a low mass matrix in the form of a wheel. The matrix is rotated at high speed into continuous consecutive contact with the respective hot and cold flows. A fixed splitter runs along a diameter of the inner circumference of the matrix in order to segregate the flows as they pass radially across the matrix. In combination with a domestic clothes dryer, the matrix is rotated directly on the drive shaft for the dryer's blower. The matrix wheel rotates between heated dryer exhaust air and incoming room air to preheat the dryer intake air.

18 Claims, 11 Drawing Figures

Fig. 8
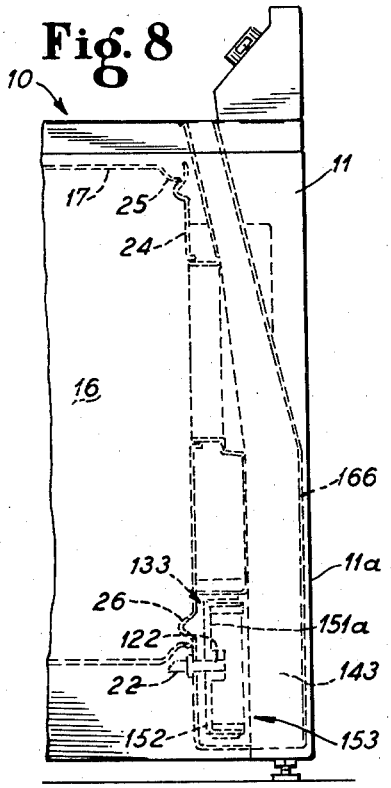
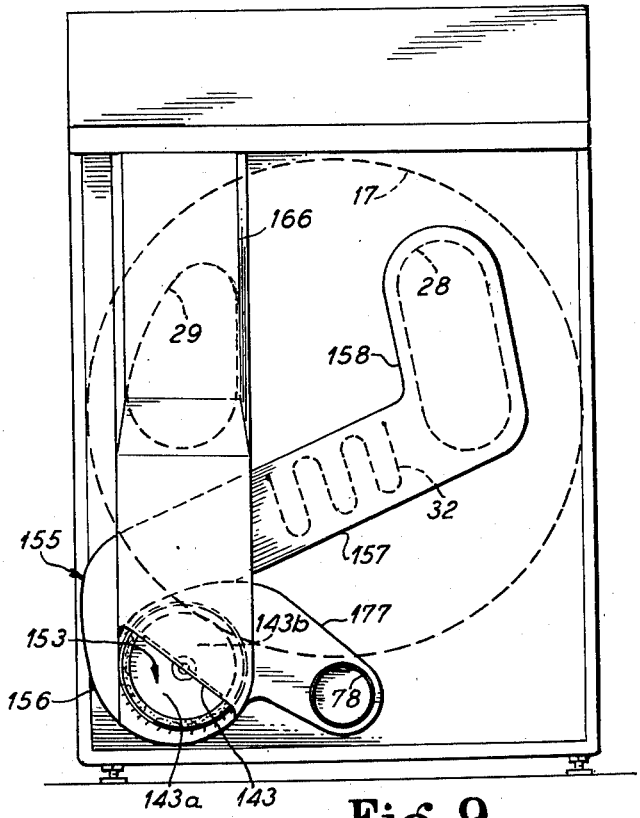
Fig. 9
Fig. 10
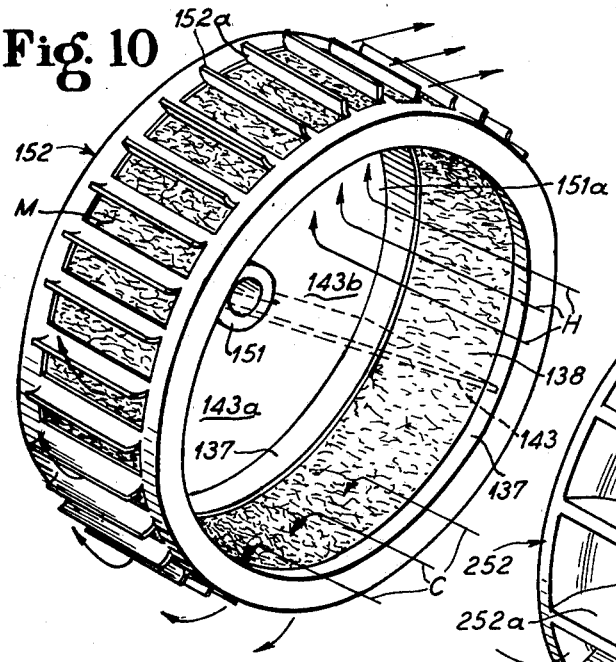
Fig. 11
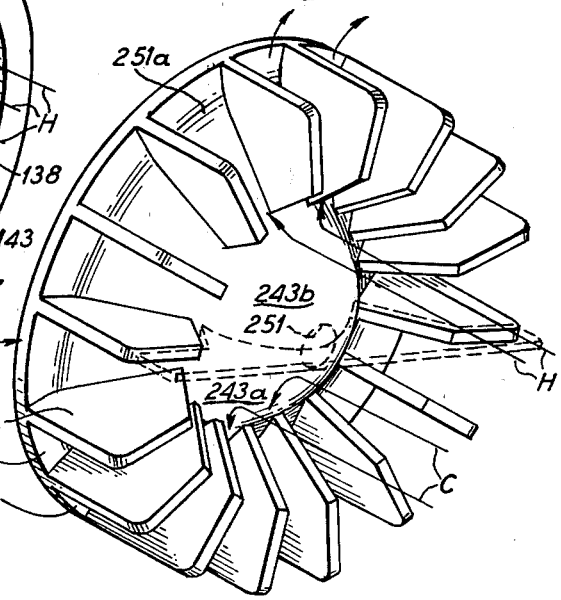

ROTATING HEAT EXCHANGER FOR A DRYER

BACKGROUND OF THE INVENTION

1. Field of the Invention

This invention relates to the field of rotary heat exchangers and more particularly to the use of such heat exchangers in a domestic clothes dryer.

2. Description of the Prior Art

Rotary regenerative heat exchangers, or rotary regenerators, typically comprise an annular matrix in the form of a wheel. The matrix is rotated into continuous consecutive contact with relatively hot and cold gas flows so that heat given up to the matrix by the hot flow can be transferred from the matrix to the cold flow. To obtain good heat transfer by the matrix, it has been generally thought that materials having high molecular density or mass, such as metallic wool, should be used for the matrix and that the wheel should revolve relatively slowly, such as about 100 rpm, in the regenerator. The high mass associated with these prior art regenerators requires that they be, in many cases, quite bulky; and the low drive speeds frequently necessitate cumbersome speed reducing mechanisms.

The heavy equipment and space considerations connected with these prior art rotary heat exchangers makes their use in domestic clothes dryers generally unacceptable. Nevertheless, it is well known that dryer apparatus may be more efficiently operated by affording heat exchange between exhaust air of the dryer and fresh intake air.

SUMMARY OF THE INVENTION

The present invention eliminates the need for a high mass matrix and low speed rotation in a rotary regenerator.

In accordance with the present invention, a rotary heat exchanger is comprised of an annular matrix in the form of a wheel generally containing relatively low mass material, such as open cell foam plastic. The matrix is driven for rotation at relatively high speed so as to be in continuous consecutive contact with separate relatively hot and cold gas flows conducted across the matrix by suitable passage means. The matrix is lightweight and, with the elimination of speed reduction equipment, makes for a compact assembly. The hot and cold flows, being passed radially across the matrix, are segregated in the interior enclosed space of the wheel by splitter means spanning the inner circumference of the wheel. In combination with a domestic clothes dryer, the heat exchanger matrix wheel may be driven directly on the dryer's blower shaft, in which case the matrix is usually revolving in excess of 1500 rpm. The heat exchanger is compact and lightweight enough to fit within standard confines for domestic dryers. Heated dryer exhaust air passes through the matrix on one side of the fixed splitter and room intake air passes through on the other side. As the matrix wheel is rotated from contact with the dryer exhaust air into contact with the incoming room air, heat is transferred to preheat the intake air.

BRIEF DESCRIPTION OF THE DRAWINGS

FIG. 8 is a partial side elevational view of the clothes dryer of FIG. 1 illustrating an alternative embodiment of the invention.

FIG. 9 is a rear elevational view of the clothes dryer of FIG. 1 illustrating the alternate embodiment shown in FIG. 8.

FIG. 10 is a perspective view of a matrix wheel constructed in accordance with the principles of the present invention for use in the embodiment shown in FIGS. 8 and 9.

FIG. 11 is a perspective view of another form of matrix wheel for use in the embodiment of FIGS. 8 and 9.

DESCRIPTION OF THE PREFERRED EMBODIMENT

Figure 1:
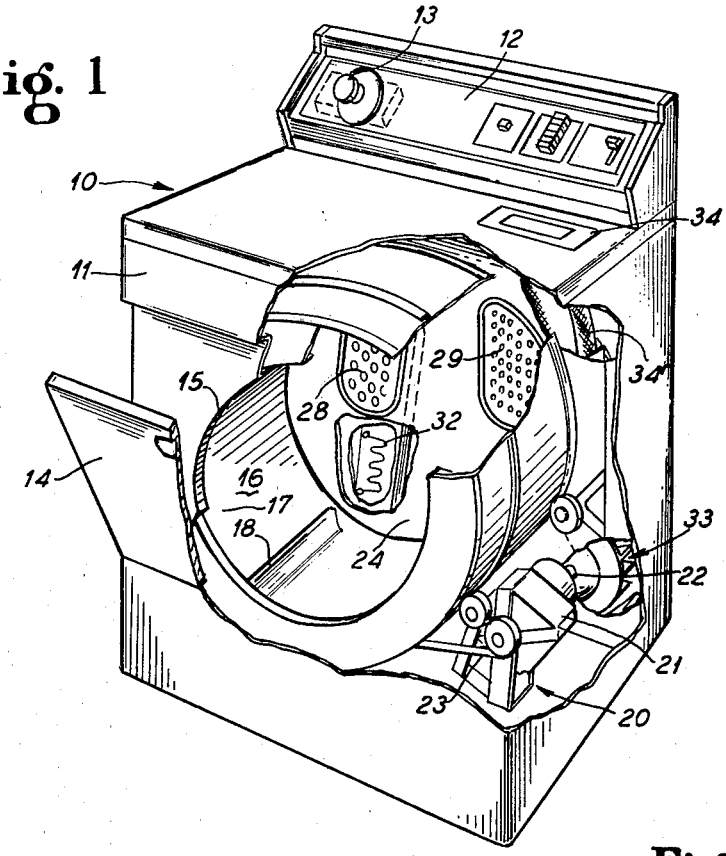
FIG. 1 is a perspective view, partly broken away, of a domestic, automatic clothes dryer embodying a rotary regenerator constructed in accordance with the principles of the present invention.

A domestic automatic clothes dryer is shown generally at 10 in FIG. 1. The dryer has a standard cabinet 11 having a control panel 12, including a control dial 13 for a presettable control means by which the dryer may be pre-set to automatically operate through a programmed sequence of a drying operation. A hinged door 14 opens on the front face of the cabinet 11. Behind the door 14 is a receptacle opening 15 through which clothes may be deposited in a treatment zone 16, characterized in this form of the invention by a drum 17 in the form of an imperforate cylindrical sidewall having radially inwardly extending vanes 18. Suitable drive means 20, including a fourpole rotary electric motor 21, drive shaft 22, and pulley means 23 connected to the drive shaft 22 at the front side of the motor 21, rotate the drum 17. It should be understood that any drum construction could be used herein in the treatment zone 16 in which a load of materials is to be dried, so long as a stream of temperature conditioned air is directed through the zone 16 to enhance the drying operation.

Figure 2:
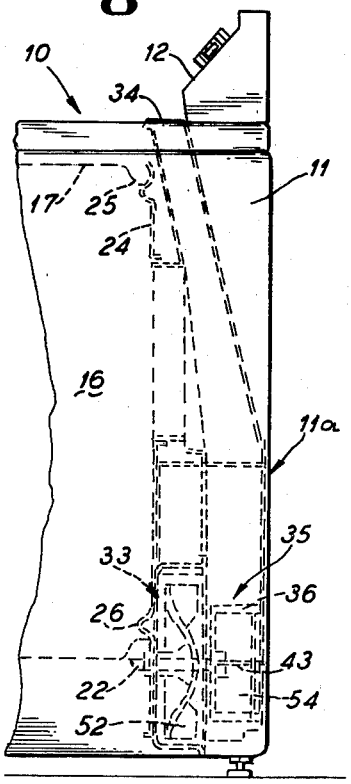
FIG. 2 is a partial side elevational view of the clothes dryer illustrated in FIG. 1.

In the exemplary form of the invention, as shown in FIG. 2, a stationary wall 24 cooperates with the drum 17 to form an end wall for the zone 16. Clothes are tumbled in zone 16 under the influence of the vanes 18 on the outer cylindrical wall of drum 17. A pair of contiguous, annular mating surfaces 25 and 26, formed respectively along the rear edge of the drum 17, and on the front surface of the end wall 24, permit the drum 17 to ride in air sealed relation against the end wall 24. As shown in FIG. 1 an air inlet 28 and air outlet 29 are formed by respective sets of perforations in the end wall 24.

Air is circulated through inlet passage means, shown in FIG. 1 through the broken away section in the end wall 24. The inlet air is heated by a heating element 32, such as an electrical element, before entering the inlet 28. The air passing through the inlet 28 into the dryer load space is heated to enhance moisture pick-up from the clothes being tumbled. Exhaust air is drawn through the outlet 29 by means of a blower 33 connected to the drive shaft 22 at the back side of the motor 21. Downstream of the outlet 29, the dryer 10 may also be provided with a lint filter, not shown, which is removable for periodic cleaning through a trap door 34 on the top face of the cabinet 11.

Figure 7:
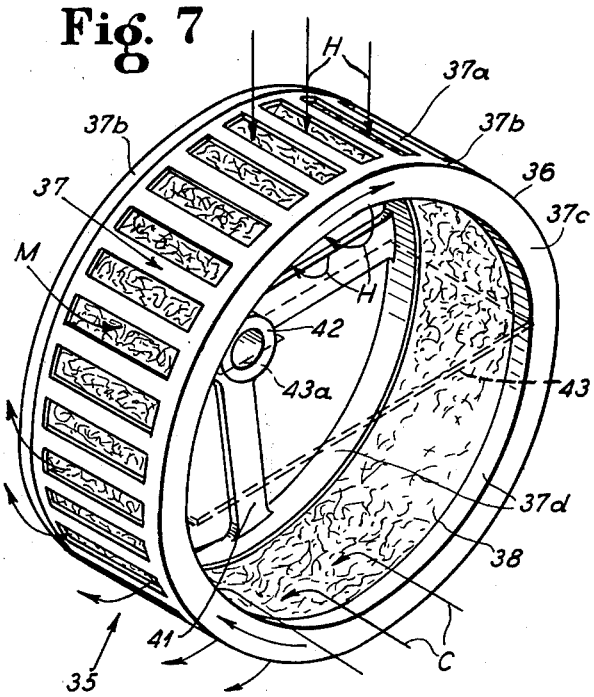
FIG. 7 is a perspective view of a matrix wheel constructed in accordance with the principles of the present invention.

Referring to FIG. 7, a heat exchanger or regenerator 35 is provided which may take the form of a cylinder or matrix wheel or annulus 36 disposed generally concentrically relative to a central axis. In the embodiment shown, the wheel has a diameter of 6½ inches. The outer annular surface 37 of the matrix wheel 36 is formed with screening means comprising axially directed bars 37*a*. The bars 37*a* are circumferentially separated from one another to form radial flow spaces therebetween. The bars 37*a* extend between outer annular sidewall surfaces 37*b*. The outer sidewall surfaces 37*b* are joined by wheel rim surfaces 37*c* extending radially inwardly to inner annular sidewall surfaces 37*d*. The inner sidewalls 37*d* are concentric with the outer surfaces 37*b* and have an annular radial flow space running between them. The outer annular surface 37, rim surfaces 37*c*, and inner annular sidewall surfaces 37*d* serve to enclose an annular matrix chamber 38 containing matrix material M. The matrix material M is porous, such that a gas flow can readily pass radially through it, is of a relatively low density or mass and may have low specific heat properties. The low mass matrix material enables the wheel 36 to be lightweight, one advantage of which is that less power is required to rotate the wheel 36. A preferred embodiment of matrix material is open cell foam plastic such as polyethylene or expanded polypropolene or some other suitable synthetic material. It is, however, within the contemplation of the present invention that the matrix wheel take the form of a blower wheel having vanes forming the matrix.

The matrix wheel 36 may be driven on a relatively high speed drive shaft such as a four pole motor shaft, operating at a nominal speed of 1725 rpm. This eliminates the need for speed reduction equipment, making the heat exchanger more compact. Further, in maintaining a compact system, the drive shaft may be mounted coaxially with the wheel 36. A plurality of radial support arms 41 extend from one sidewall surface 37*d* to a coaxial hub portion 42. The hub 42 may be fixedly secured to a drive shaft for direct rotation therewith.

A splitter means 43, shown by broken lines in FIG. 7, is stationarily mounted within the interiorly enclosed space of wheel 36. The splitter 43 comprises a generally rectangular planar wall surface extending along a diameter of the circumference of the inner sidewall surfaces 37*d* and having a width substantially equal to that of the axial width of the wheel 36. A recess portion 43*a* accommodates the hub 42.

In operation, relatively high temperature hot gas flows in a first stream or flow, as illustrated by arrows H, radially across annular chamber 38 and axially out from the enclosed space of the wheel 36. Relatively low temperature cold gas passes in a second stream or flow, as illustrated by arrows C, axially into the enclosed space of the wheel 36 and radially out across chamber 38. The splitter 43 serves to segregate the first and second counterflowing streams. The low mass of the matrix material M in the matrix wheel 36 and high rate of rotation of the wheel 36 provide good heat exchange properties so that the regenerator 35 is effective in transferring heat between the streams, i.e., from the hot gas to the cold gas. The principle is the same regardless of variations in gas flow directions. A possible explanation of how the heat exchanger 35 of the present invention is able to be effective is that some of the hot gas is transferred into the cold gas flow. Also, the porous mass of matrix material M appears to function as a heat sink from which thermal energy may be readily transferred between adjacent streams of air H and C.

Figure 3:
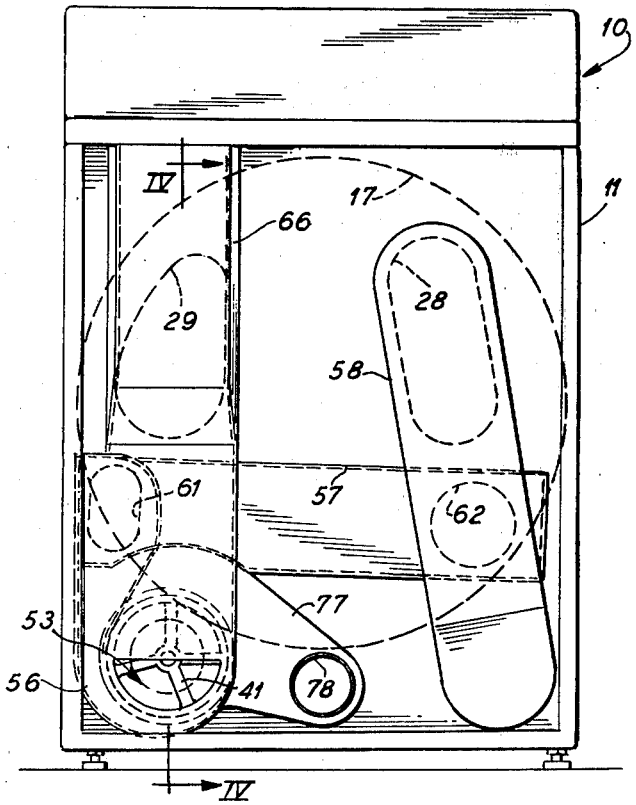
FIG. 3 is a rear elevational view of the clothes dryer illustrated in FIG. 1.
Figure 4:
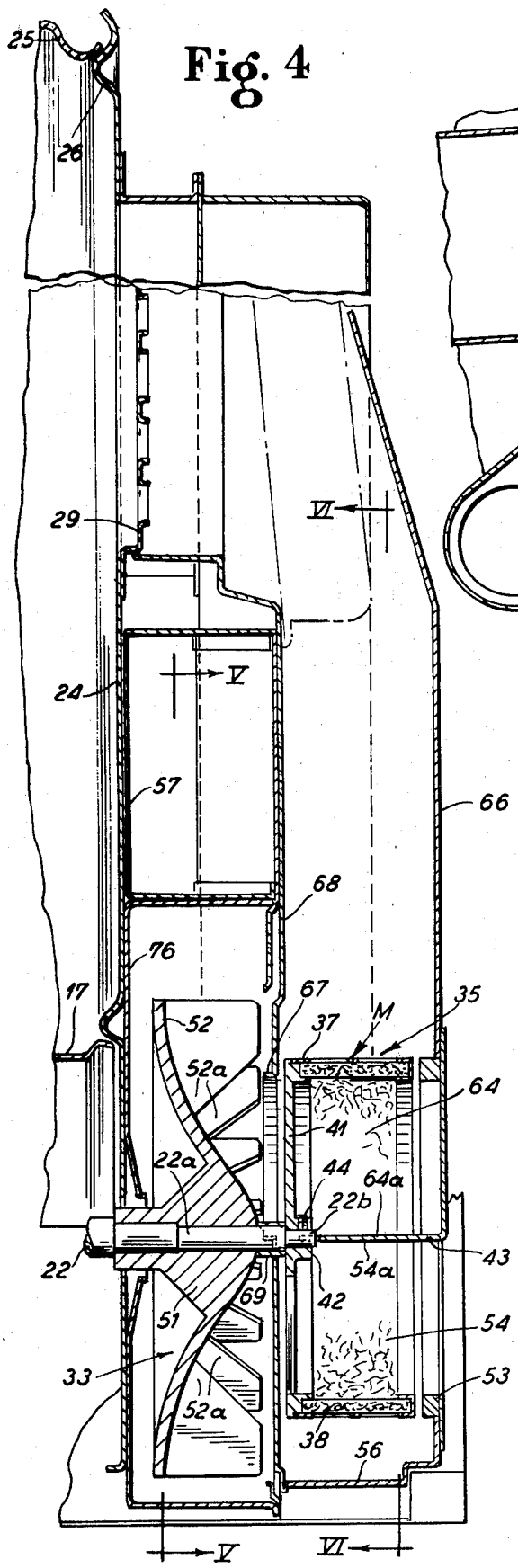
FIG. 4 is a sectional view taken along the lines IV—IV of FIG. 3.

When incorporated in the standard cabinet confine 11 of a clothes dryer 10, the heat exchanger wheel 36 may be driven directly on the drive shaft for the air blower 33. Referring to FIGS. 2, 3 and 4, a drive shaft member 22*a* serves, by connection with an impeller hub 51, to rotate an air blower impeller or wheel 52. The impeller 52 is formed with circumferentially spaced radial blades 52*a*. Shaft member 22*a* is a rearward extension of motor drive shaft 22 making for a convenient assembly. Extending rearward from shaft 22*a* is stub shaft portion 22*b*, which serves as the drive shaft for the wheel 36. Attachment means, such as set screw 44, secure the wheel hub 42 onto the stub shaft 22*b* for direct rotation with the blower 33 and four pole motor 21. Accordingly, the matrix wheel 36 is usually revolving at a nominal speed of 1725 rpm.

The regenerator 35 serves to preheat incoming dryer intake air with the heat from the dryer's exhaust flow, thereby enhancing the operating efficiency of the dryer. Initially, room intake air enters the dryer 10 through a plurality of openings, not shown, in the rear wall 11*a* of the cabinet 11. As illustrated in FIG. 4, the splitter 43 is formed as an interiorly extending surface of the rear wall 11*a*. The air passes through an inlet opening 53 formed in a duct portion 56 into an inlet portion 54 of the matrix wheel 36 beneath a side 54*a* of the splitter 43. The air passes radially through chamber 38 containing the matrix material M.

Figure 6:
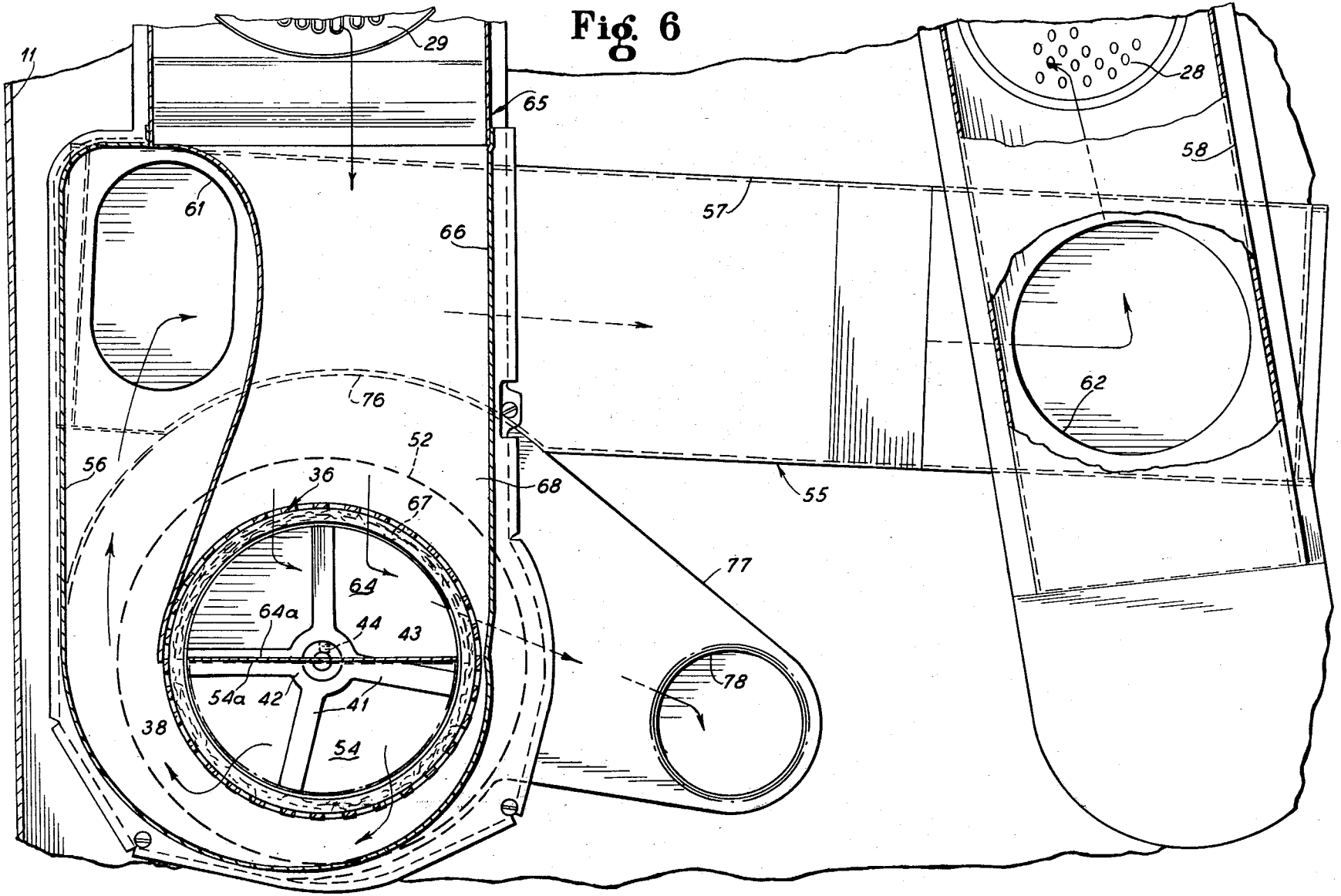
FIG. 6 is a sectional view taken along the lines VI—VI of FIG. 4.

As illustrated in FIGS. 3 and 6, an inlet air passage means 55 conducts the intake air to the dryer air inlet 28.

The inlet air passage means 55 comprises a series of connecting duct portions 56–58. A first duct means 56 comprises a generally volute-shaped lower chamber formed about the regenerator inlet portion 54 communicating along a vertically extending channel to an opening 61. The air passes through opening 61 into a generally horizontally extending channel or duct means 57. An opening 62, formed at the opposite end of duct 57 from opening 61, fluidly connects duct 57 with third duct means 58. The duct means 58 contains the heating element 32, shown in FIG. 1, which raises the temperature of the intake air sufficiently for utilization in the dryer treatment zone 16. The third duct 58 comprises a generally vertically extending channel having communication at its upper end with the interior of the drum 16 through the rear wall air inlet 28.

Air exhausts from the dryer drum 16 through the rear wall air outlet 29 and passes through an outlet passage means 65. The outlet passage means 65 comprises an exhaust duct 66 extending generally downward from the outlet 29 and opening onto the upper surfaces of matrix wheel 36. The heated exhaust air passes radially through matrix chamber 38 into an outlet portion 64 of the wheel 36 above a side 64*a* of the splitter 43. As shown in FIGS. 4 and 6, the exhaust air flows axially forward from outlet portion 64 through an opening 67 in a wall member 68 positioned intermediate the wheel 36 and the impeller 52.

Because the exhaust air entering the matrix is still at a high temperature relative to the room intake air temperature, the regenerator 35 transfers heat from the dryer heated air to the incoming intake air. Hence, dryer intake air passing through inlet passage means 55 is preheated, which reduces the energy expenditure necessary for heating element 32 to raise the temperature of the intake air before it enters the dryer load space. Also, the travel of the wheel 36 in the regenerator 35 has a self-cleaning effect on the matrix material M since the exhaust air enters outlet portion 64 radially inwardly and room air exits inlet portion 54 radially outwardly, tending to clean off any lint collected from the exhaust air flow and collecting on the outer surface of the matrix.

Figure 5:
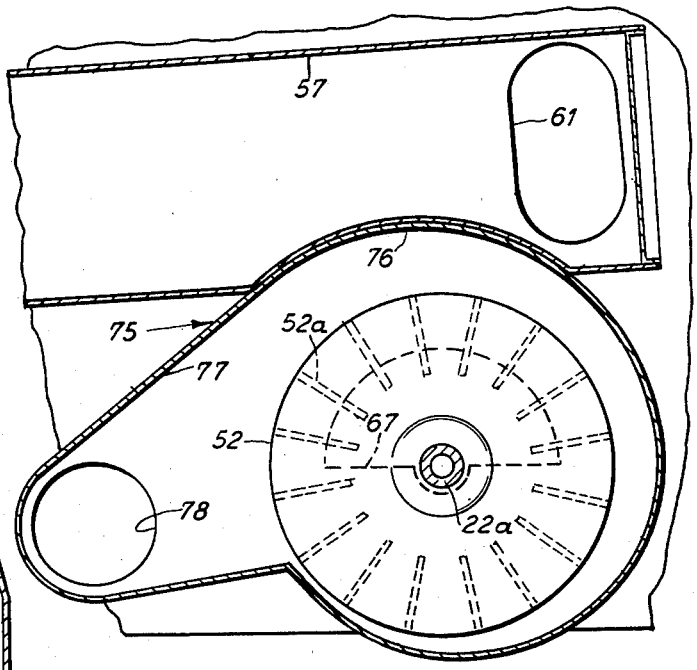
FIG. 5 is a sectional view taken along the lines V—V of FIG. 4.

Intermediate wall 68 is fitted with a bearing means 69 beneath the opening 67 which acts as an end support for the drive shaft 22 between the blower impeller 52 and the regenerator wheel 36. As shown in FIG. 5, opening 67 serves as the inlet for the blower 33, which draws the exhaust air axially inward and expels it radially outward into an exit passage portion 75 of the outlet passage means 65. The exit passage 75 comprises a volute-shaped delivery chamber 76 about the blower impeller 52 which leads to a channel 77 having an exit opening 78 from which dryer exhaust air passes out of the dryer 10.

An alternative preferred form of the invention utilizing the same number designations for corresponding components as in the previous embodiment is shown in FIGS. 8, 9 and 10. A parallel unidirectional flow of the hot and cold air streams into the matrix is utilized with the matrix exchanger formed in the blower wheel, thus eliminating the need to have both a blower wheel and a matrix wheel. In this embodiment the motor drive shaft 22 terminates in a rearward extension 122. Extension 122 is connected in driving relationship to a blower wheel 152 at a hub portion 151 formed in blower wheel rear wall 151*a*. The blower wheel 152 is formed with circumferentially biased radial blades 152*a*. Room air enters the dryer through a plurality of openings, not shown, in the rear wall 11*a* of the cabinet 11, thereafter entering an inlet opening 153 in a duct 156 to an inlet portion 143*a* of blower wheel 152. An exhaust duct 166 has a surface extending into the interior of the blower wheel 152 to form a splitter 143. Inlet air passage means 155 conducts the inlet air to the dryer inlet 28. The inlet passage means 155 comprises generally volute-shaped lower chamber 156 formed about the blower wheel 152, a transverse duct 157 housing heating element 32 and communicating with duct 156, and a duct 158 communicating with air inlet opening 28. Air passing through inlet duct means 155 and inlet opening 28 exits the drum 17 through the rear wall air outlet 29 and passes through air exhaust duct 166. Air exhaust duct 166 extends generally downwardly from the outlet 29 and terminates at splitter 143 in an exhaust portion 143*b* of blower wheel 152. The exhaust air passes radially through the blower wheel into a duct 177 for passage to dryer outlet 78.

Referring to FIG. 10, hot exhaust air H and cold inlet air C flow unidirectionally in parallel on opposite sides of splitter 143 into respective inlet 143*a* and exhaust 143*b* portions of the blower wheel 143. The wheel 152 is provided with an annular matrix M fitted in a channel 138 formed by outer annular channel rims 137. The rims 137 further provide connecting means for the blades 151. The hot exhaust air H flows through the matrix M from the exhaust portion 143*b* through duct 177 to the dryer outlet 78. The cold inlet air C flows through matrix M from the inlet portion 143*a* to the volute duct 156 for passage to dryer inlet 28. In this embodiment, the unidirectional parallel flow generator 135 thus serves to preheat the incoming dryer intake air with the dryer exhaust air flow, with the wheel 152 also acting as the air calculating blower wheel. It has also been found that the blower wheel blades 151 act as a heat exchanger matrix even without the matrix material M inserted in the wheel 152.

An alternate preferred form of the blower wheel to be utilized in the embodiment of FIGS. 8 and 9 is shown in FIG. 11. The plastic impeller wheel 252, which is of the same configuration as the blower wheel 52 shown in FIGS. 2 and 4, is comprised of a disc portion 251*a* having a molded in hub 251 for attachment to motor drive shaft extension 122 and having a plurality of circumferentially spaced blades 252*a* formed thereon. A splitter 243 formed as an inwardly extending surface of duct 166 divides the wheel into inlet portion 243*a* for cold air flow and exhaust portion 243*b* for hot air flow. In operation similar to blower wheel 152 shown in FIG. 10, the blades 252*a* perform the matrix heater exchanger function as well as the air flow blower function.

It will be understood that the regenerator of the present invention may take the form of a blower wheel with or without a matrix material M, and thus eliminate the need to have both a blower wheel and a matrix wheel, and that a two pole motor doubling the speed of the matrix wheel is contemplated by the invention. Also, that the regenerator of the present invention will have applications in systems other than domestic appliance dryers, but that such application constitutes the preferred embodiment.

Although modifications and changes may be suggested by those skilled in the art, it is the intention of the inventor to embody within the patent warranted hereon all changes and modifications as reasonably and properly come within the scope of his contribution to the art.

The embodiment of the invention in which an exclusive property or privilege is claimed are defined as follows:

1. In a dryer having a drum for tumbling a clothes load and a motor-driven blower for circulating air from an air inlet through a heating means for heating said air, through said drum and to an air exhaust, a heat exchanger for exchanging heat from said heated air after passage through said drum to said air entering said air inlet, said exchanger comprising:

an annular rotatable matrix containing low density matrix material permitting radial gas flow therethrough, drive means connected to said motor for rotating said matrix, a splitter means stationarily mounted within said matrix for dividing said matrix into an inlet portion in air flow communication with said heating means and an outlet portion in air flow communication with said air exhaust;

an inlet air passage means for directing air from said air inlet radially through said matrix at said inlet portion to said heating means; and outlet air passage means for directing heated air from said drum radially through said matrix at said air outlet portion to said air exhaust, whereby inlet and outlet air flows have a self-cleaning effect on said matrix material.

2. The dryer of claim 1 wherein the air from said air inlet and the heated air from said drum pass in unidirectional parallel flow into said inlet portion and said outlet portion respectively.

3. The dryer of claim 2 or claim 1 wherein said motor driven blower comprises a blower wheel having a plurality of blades formed along a circumference thereof, said blower wheel mounted upon a driveshaft, said matrix drive means connected for direct rotation with said driveshaft and mounting said matrix adjacent said blades.

4. In a domestic appliance clothes dryer having cabinet walls, a drum for tumbling a clothes load, a rotary motor means, a blower wheel mounted on a driveshaft connected for rotation by said motor means, passage means for allowing intake air to flow through an inlet, through said drum and through an outlet, a heating means within said passage means for heating air passage therethrough, and a heat exchange means for preheating intake air upstream of said heating means comprising:

a low density annular rotatable matrix, first duct means for conducting a heated exhaust air from across an outlet portion of said matrix, said first duct means fluidly connected to said outlet and conducting exhaust air radially into and axially out from said outlet portion, said blower being mounted downstream from said outlet portion such that said blower draws air through said outlet portion, second duct means for conducting a fresh intake air flow across an inlet portion of said matrix, said second duct means fluidly connected to said heating means and said inlet; and matrix drive means for rotating said matrix in continuous consecutive contact with said respective heated exhaust and fresh intake flows at said respective outlet and inlet portions, said matrix drive means being connected for direct rotation with said driveshaft at blower wheel speeds.

5. The domestic appliance clothes dryer of claim 4, the improvement further comprising:

wherein said matrix is mounted for rotation coaxially behind said blower and said matrix drive means is an extension of said blower driveshaft.

6. The domestic appliance clothes dryer of claim 4, the improvement further comprising:

said first and second duct means conducting said exhaust and intake air flows in relative counterflow relationship.

7. In a domestic appliance clothes dryer having cabinet walls, a drum for tumbling a clothes load, a rotary motor means, a blower wheel mounted on a driveshaft connected for rotation by said motor means, passage means for allowing intake air to flow through an inlet, through said drum and through an outlet, a heating means within said passage means for heating air passage therethrough, and a heat exchange means for preheating intake air upstream of said heating means comprising:

a low density annular rotatable matrix, first duct means for conducting a heated exhaust air from across an outlet portion of said matrix, said first duct means fluidly connected to said outlet, second duct means for conducting a fresh intake air flow across an inlet portion of said matrix, said second duct means fluidly connected to said heating means and said inlet, matrix drive means for rotating said matrix in continuous consecutive contact with said respective heated exhaust and fresh intake flows at said respective outlet and inlet portions, said matrix drive means being connected for direct rotation with said driveshaft at blower wheel speeds, and a fixed splitter means spanning the inside circumference of said matrix, said first and second duct means conducting said respective exhaust air and intake air flows radially across said matrix such that said splitter means serves to segregate said intake air and exhaust air flows.

8. The domestic appliance clothes dryer of claim 7, the improvement further comprising:

wherein said splitter means is an inwardly extending surface of the back wall of said dryer cabinet.

9. For use in a cabinet of a domestic dryer of the type having a treatment zone formed with an inlet and an outlet, and a motor-driven blower to provide a stream of air from said inlet through said treatment zone to said outlet, the improvement of:

a matrix made of a porous low mass material disposed within said cabinet adjacent the treatment zone between the inlet and outlet;

means for continuously moving the matrix successively through first and second temperature zones, said first and second temperature zones fluidly connected to said outlet and inlet respectively, said matrix taking on a supply of thermal energy from said stream of air in the first zone and transferring said thermal energy to said stream of air in the second zone, whereby the matrix transfers heat exiting from the treatment zone into the air entering the treatment zone, and inlet air passage means for directing air radially through said matrix to said second treatment zone and outlet air passage means for directing air from said first treatment zone radially through said matrix, wherein said matrix is cylindrical in shape and is continuously moved in co-rotation with said blower.

10. The improvement of claim 9, further including a fixed splitter means spanning an inner diameter of said matrix.

11. In a domestic appliance clothes dryer having cabinet walls, a drum for tumbling a clothes load, a rotary motor means for driving said drum, passage means for allowing ambient air to flow through an inlet to said drum and exhaust from said drum through an outlet, a heating means within said passage means upstream of said drum for heating air passing therethrough, and a heat exchange means for preheating intake air upstream of said heating means comprising:

a blower wheel means in said passage means having a circumferential array of radial flow directing surfaces spaced thereabout for directing air flow through said passage means, a drive means connected to said motor means for rotating said blower wheel at high speed, a splitter means spanning the inner circumference of said blower wheel for dividing said blower wheel means into an inlet portion in air flow communication leading to said heating means and an outlet portion in air flow communication leading to said outlet, such that said blower wheel means is in continuous consecutive contact with relatively cold intake air and relatively hot exhaust air and transfers heat therebetween.

12. The dryer of claim 11, wherein said blower wheel means comprises an annular matrix of low density material.

13. The dryer of claim 11, wherein said blower wheel means comprises a hub, said radial flow directing surfaces comprising radially directed blades formed on said hub.

14. The dryer of claim 11, wherein said passage means conducts intake air and exhaust air through said blower wheel means in relative counterflow relationship.

15. For use in a cabinet of a domestic dryer having a treatment zone formed with an inlet and an outlet, a high speed rotary motor having an output shaft, a blower wheel mounted on a driveshaft coaxially and in common rotation with said output shaft to provide a stream of air from said inlet through said treatment zone to said outlet, a low density annular rotatable matrix mounted directly on said driveshaft for corotation with said blower wheel, passage means for dividing the peripheral path of said matrix into first and second temperature zones and fluidly connecting said first and second temperature zones to said outlet and to said inlet respectively, and a fixed splitter means spanning the inside circumference of said matrix to segregate said first and second temperature zones, inlet air passage means for directing air radially through said matrix at said second temperature zone, and outlet air passage means for directing air radially through said matrix at said first temperature zone, such that during rotation said matrix takes on a supply of thermal from said stream of air in said first zone and transfers said thermal energy to said stream of air in said second zone whereby said matrix transfers heat exiting from said treatment zone into the air entering said treatment zone.

16. The apparatus of claim 15, wherein said blower wheel and said matrix are driven at a nominal speed of 1725 rpm.

17. The apparatus of claim 15, wherein said rotary motor is a four-pole electric motor.

18. In a domestic appliance clothes dryer having cabinet walls, a drum for tumbling a clothes load, a rotary motor means, a blower wheel mounted on a driveshaft connected for rotation by said motor means, passage means for allowing intake air to flow through an inlet, through said drum and through an outlet, a heating means within said passage means for heating air passage therethrough, and a heat exchange means for preheating intake air upstream of said heating means comprising:

a low density annular rotatable matrix, first duct means for conducting a heated exhaust air from across an outlet portion of said matrix, said first duct means fluidly connected to said outlet, second duct means for conducting a fresh intake air flow across an inlet portion of said matrix, said second duct means fluidly connected to said heating means and said inlet, matrix drive means for rotating said matrix in continuous consecutive contact with said respective heated exhaust and fresh intake flows at said respective outlet and inlet portions, said matrix drive means being connected for direct rotation with said driveshaft at blower wheel speeds, said first duct means conducting exhaust air radially through said matrix at said outlet portion, said second duct means conducting intake air radially through said matrix at said inlet portion, and means for segregating said intake air and exhaust air flows in said heat exchange means such that said matrix moves successively into contact with said intake air and exhaust air.

* * * * *